US007914227B2

(12) United States Patent
Jordan et al.

(10) Patent No.: US 7,914,227 B2
(45) Date of Patent: Mar. 29, 2011

(54) THERMALLY AND ELECTRICALLY INSULATED COMPOSITE MANHOLE COVERS

(75) Inventors: Lawrence E. Jordan, Amsterdam, NY (US); Anthony F. Mitola, Saratoga Springs, NY (US)

(73) Assignees: Energy Products, LLC, Saratoga Springs, NY (US); Power and Composite Technologies LLC, Amsterdam, NY (US)

( * ) Notice: Subject to any disclaimer, the term of this patent is extended or adjusted under 35 U.S.C. 154(b) by 140 days.

(21) Appl. No.: 12/466,201

(22) Filed: May 14, 2009

(65) Prior Publication Data

US 2009/0290934 A1 Nov. 26, 2009

Related U.S. Application Data

(60) Provisional application No. 61/053,442, filed on May 15, 2008.

(51) Int. Cl.
*E02D 29/14* (2006.01)

(52) U.S. Cl. ..... 404/25; 52/19; 52/20

(58) Field of Classification Search ..... 404/2, 4, 404/25, 26; 52/19, 20
See application file for complete search history.

(56) References Cited

U.S. PATENT DOCUMENTS

| | | | | |
|---|---|---|---|---|
| 3,920,347 A | | 11/1975 | Sauriol et al. | 404/25 |
| 4,013,374 A | | 3/1977 | Weiler et al. | 404/25 |
| 4,289,563 A | * | 9/1981 | Wiechowski et al. | 156/423 |
| 4,662,777 A | | 5/1987 | Newton | 404/25 |
| 4,726,707 A | | 2/1988 | Newton | 404/25 |
| 4,861,186 A | * | 8/1989 | Ferns | 404/25 |
| 4,873,795 A | * | 10/1989 | Spiess et al. | 52/20 |
| 5,123,776 A | | 6/1992 | Lang et al. | 404/25 |
| 5,201,151 A | | 4/1993 | LeBlanc et al. | 52/20 |
| 5,240,346 A | | 8/1993 | Yin | 404/25 |
| 5,312,202 A | | 5/1994 | Newton | 404/25 |
| 5,378,078 A | | 1/1995 | Lewis et al. | 404/25 |

(Continued)

FOREIGN PATENT DOCUMENTS

JP 5112957 5/1993

OTHER PUBLICATIONS

Removable Steel Cover with Epoxy Surface, Consolidated Edison Company of N.Y. Inc., Engineering Drawing No. EO-12428-B, 1 page, May 6, 1965.

(Continued)

*Primary Examiner* — Raymond W Addie
(74) *Attorney, Agent, or Firm* — Heslin Rothenberg Farley & Mesiti P.C.

(57) ABSTRACT

A manhole cover includes a support having an upper surface and a peripherally-extending portion. An outer insulating member is disposed over the entire upper surface of the support, and the support comprises a first material and the outer insulating member comprises a second material different from the first material. The peripherally-extending portion of the support is positionable over the lip of the manhole ring. The outer insulating member is positionable between the upper surface of the support and the upper surface of the rim of the manhole ring when the manhole cover is received in the manhole ring. In one aspect, the support comprises cross-members defining a grate having passageways through the support. In another aspect, the support comprises metal, and the outer insulating member comprises a composite of resin, reinforcement fibers, and stone aggregate. In another aspect, screen inserts are disposed in a plurality of passageways in the outer insulating member.

75 Claims, 8 Drawing Sheets

U.S. PATENT DOCUMENTS

| | | | | |
|---|---|---|---|---|
| 5,529,431 | A | 6/1996 | Walsh | 404/25 |
| 5,564,855 | A * | 10/1996 | Anderson | 404/26 |
| 5,797,221 | A | 8/1998 | Young et al. | 52/20 |
| 6,393,771 | B1 | 5/2002 | Stetson | 52/50 |
| 6,464,425 | B1 | 10/2002 | Closkey | 404/26 |
| 6,851,225 | B1 | 2/2005 | Haar et al. | 52/20 |
| 6,887,012 | B1 | 5/2005 | Zappe | 404/25 |
| 7,283,055 | B2 | 10/2007 | Didik | 340/573.1 |
| 7,297,720 | B2 | 11/2007 | Meyers, III et al. | 521/40 |
| 7,354,220 | B1 * | 4/2008 | Corr | 404/73 |
| 7,361,834 | B1 | 4/2008 | Trangsrud et al. | 174/66 |
| 7,537,413 | B1 * | 5/2009 | Brugos | 404/25 |
| 7,748,926 | B2 * | 7/2010 | Jurich et al. | 404/25 |
| 2002/0176743 | A1 | 11/2002 | Shumlansky et al. | 404/26 |
| 2003/0097802 | A1 * | 5/2003 | Kim et al. | 52/19 |
| 2004/0040221 | A1 | 3/2004 | Airheart | 52/20 |
| 2008/0050175 | A1 | 2/2008 | Brady et al. | 404/25 |
| 2009/0120013 | A1 * | 5/2009 | Meyers | 52/20 |
| 2009/0211170 | A1 * | 8/2009 | Burlando | 52/20 |
| 2010/0043305 | A1 * | 2/2010 | Donnellan et al. | 52/20 |

OTHER PUBLICATIONS

The Benefits of Thrubeam Composite Covers Over Traditional Covers, Structural Science Composites Company, United Kingdom, printout available online on May 12, 2009, at http://www.structuralscience.net/benefits.htm, 2-pages.

TrueBeam Round Sealed Cover and Frames, Product No. R76, Structural Science Composites Company, United Kingdom, printout available online on May 12, 2009, at http://www.structuralscience.net/datasheets/R76%20ROUND%20SEALED-METRIC.pdf, 2-pages, Jul. 31, 2008.

* cited by examiner

THERMALLY AND ELECTRICALLY INSULATED COMPOSITE MANHOLE COVERS

CLAIM TO PRIORITY

This application claims the benefit of U.S. Provisional Application No. 61/053,442, filed May 15, 2008, entitled "Manhole Cover," the entire subject matter of which is hereby incorporated herein by reference.

FIELD OF THE INVENTION

The invention relates in general to manhole covers, and in particular to composite manhole covers.

BACKGROUND OF THE INVENTION

Manhole covers made of cast iron make-up the bulk of access covers in urban streets around the world. These covers have a proven record of durability, strength, and functionality. The high density of iron results in a cover of substantial weight preventing cover displacement during flooding conditions and minimizing the occurrence of theft.

Numerous attempts have been made to employ non-metallic covers. For example, U.S. Pat. No. 5,123,776 issued to Lang et al. discloses a manhole cover having an outer surface fabricated from a plastic material while an interior chamber is filled with cement. U.S. Patent Application Publication No. 2008/0050175 by Brady et al. discloses a lightweight reinforced composite manhole assembly that includes a manhole cover and base, which may be formed by injection molding.

Another attempt by Consolidated Edison Company includes a removable rectangular steel cover with an epoxy cover. The cover comprised a ¼-inch elongated solid steel plate, the ends of which were disposed 3/16-inch below the upper end of L-shaped brackets. A plurality of ¼-inch thick spaced-apart longitudinally-extending ribs were welded to the bottom of the steel plate. A 3/16-inch layer of epoxy was disposed on the outer surface of the cover between the upper portions of the L-shaped brackets and even with the upper portions of the L-shaped brackets.

An earlier approach by the applicant of the present invention involved employing a cast iron manhole cover having a recessed pocket on the top. In particular, the cast iron manhole cover had a raised peripherally-extending border disposed around the pocket. When the cast iron manhole is positioned and supported on the lip of a manhole, the top surface of the border is disposed at the same lever as the top surface of the rim of the manhole, e.g., the ground or road surface. The recessed pocket was filled with a resin and glass fiber composite. The resin was also coated over the top surface of the peripherally-extending border.

There is a need for further manhole covers, and in particular, thermally and electrically insulating manhole covers.

SUMMARY OF THE INVENTION

In a first aspect, a manhole cover for use in covering a manhole ring having a rim and a lip. The manhole cover includes a support having an upper surface, and an outer thermally and electrically insulating member disposed over the entire upper surface of the support. The support comprises a first material, and the outer insulating member comprises a second material different from the first material. A peripherally-extending portion of the support is positionable over the lip of the manhole ring and spaced adjacent to an inner surface of the rim of the manhole ring, and the outer insulating member is positionable between the upper surface of the support and the upper surface of the rim of the manhole ring when the manhole cover is received in the manhole ring.

In a second aspect, the present invention provides the support comprises a plurality of spaced-apart cross-members defining a grate having a plurality of passageways through the support, and ends of some of the plurality of spaced-apart cross-members defining the peripherally-extending portion of the support comprising a plurality of spaced-apart peripherally-extending portions positionable over the lip of the manhole.

In a third aspect, the present invention provides the support comprises metal, and the outer insulating member comprising a composite of resin, reinforcement fiber, and stone aggregate.

In a fourth aspect, the present invention provides a plurality of screen inserts disposed in a plurality of passageways in the outer insulating member.

In a fifth aspect, the present invention provides the support comprising a solid plate.

In a sixth aspect, the present invention provides a combination manhole and manhole cover. The combination includes a manhole having a lip defining an opening, and the above-noted manhole covers disposed in the opening.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

The invention is directed to manhole covers, and in particular to thermally and electrically insulated manhole covers with reinforcement which overcome the problems typically associated with traditional all metal cast iron covers and prior art composite manhole covers. For example, the present invention reduces the likelihood of risks of burning and electrocution associated with conventional manhole covers as described in greater detail below.

Generally, in one embodiment, a manhole cover in accordance with the present invention includes a support, e.g., formed from metal, and an outer non-metallic thermally and electrically insulating material or member, e.g., a composite. The cover, including the support and the outer non-metallic member may be provided with openings to allow a release of pressure, e.g., from below ground, without dislodging. The insulating qualities of the composite on the top exposed surface inhibit contact with the internal support such as a steel or cast iron support which therefore reduces the likelihood of burning or electrocution which could otherwise occur due to contact with conventional metal manhole covers.

Where pressure is not a concern, in another embodiment of a manhole cover in accordance with the present invention, the manhole cover need not include openings and may have a solid configuration.

As described in greater detail below, the manhole covers in accordance with the present invention may advantageously retain the strength and weight properties of the conventional metal manhole covers, provide thermal and electrical properties that reduce surface temperature of the manhole covers thereby minimizing the potential for thermal burns to people and animals, provide electrical isolation thereby reducing the likelihood of electrocution or electrical burns to people and animals, minimize the potential for unintentional dislodging, and minimize the occurrence of vandalism and theft.

Figure 1:
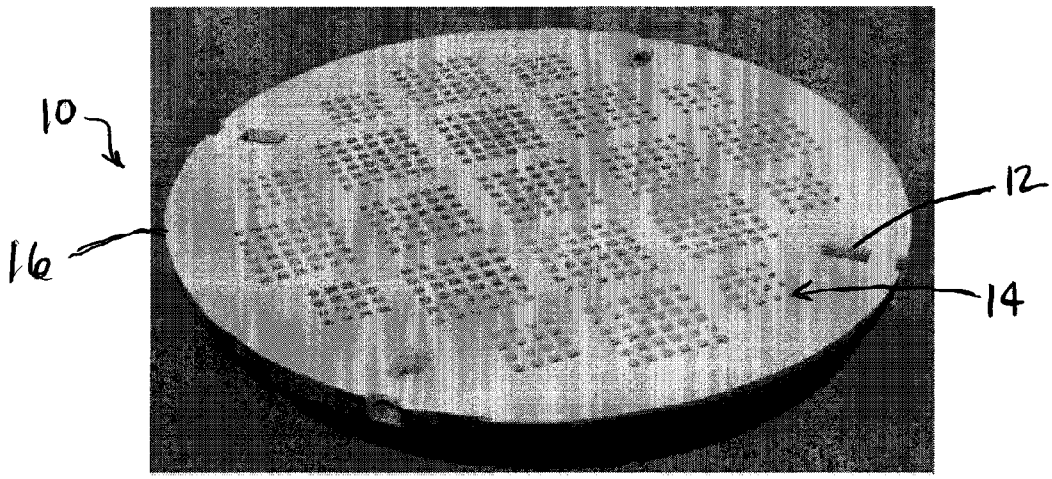
FIG. 1 is a perspective view of a first embodiment of a thermally and electrically insulated manhole cover in accordance with the present invention.
Figure 2:
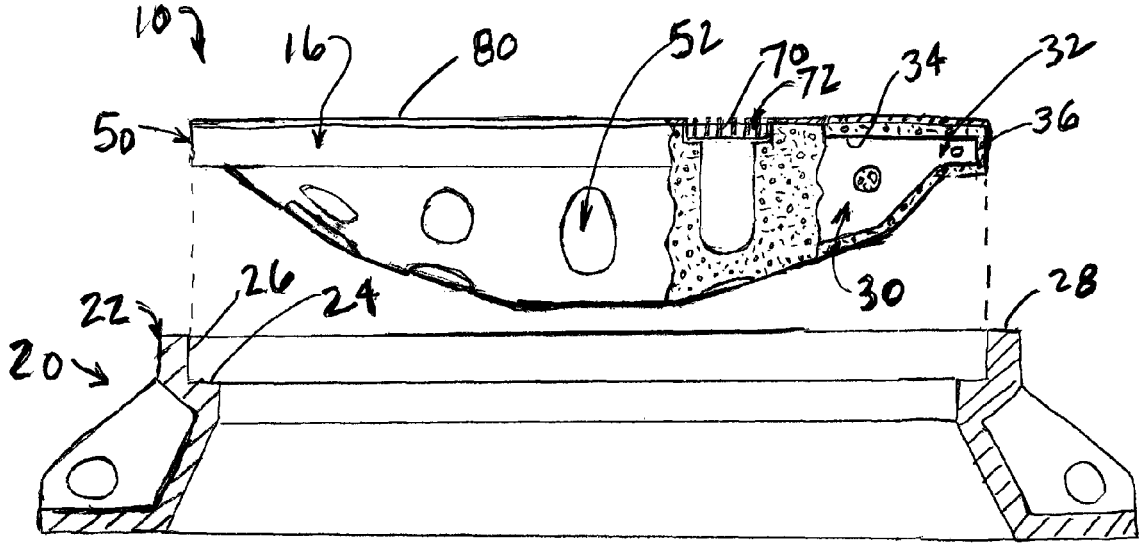
FIG. 2 is a side elevational view, partially cut away, of the thermally and electrically insulated manhole cover of FIG. 1 along with a cross-sectional view of a manhole ring having a lip for supporting the manhole cover.

FIGS. 1 and 2 illustrate a first embodiment of a thermally and electrically insulating manhole cover 10 in accordance with the present invention. Manhole cover 10 generally includes peripherally-extending portion 16 supportable on a peripherally-extending lip 24 (FIG. 2) and within an inner surface 26 (FIG. 2) of a peripherally-extending rim 22 (FIG. 2) of a manhole ring 20 (FIG. 2) for covering the manhole. Pick holes 12 (FIG. 1) may be provided in the manhole cover for use in removing the manhole cover from the manhole. While the term manhole ring is used to define the structure for receiving the manhole cover, it will be appreciated that the manhole ring need not be round for receiving a circular-shaped cover but may be square or rectangular or other configuration for receiving a square, rectangular, or other configured covers.

As best shown in FIG. 2, manhole cover 10 may include an inner structural member or support 30, an outer thermally and electrically insulating material or member 50, and a plurality screen inserts 70 for providing a plurality of vent holes 72. Support 30 may include a peripherally-extending portion 32 which is sized and positionable over lip 24 of manhole ring 20. An upper surface 34 of support 30 is disposable below an upper surface 28 of peripherally-extending rim 22 of manhole ring 20. Peripherally-extending portion 32 may be sized so that support 30 is inhibited, and also the cover, from passing through the manhole ring.

Outer insulating member 50 is disposed over generally an entire upper surface of support 30 and adjacent to an inner surface 26 of rim 22 of manhole ring 20. The outer insulating member 50 is positionable between upper surface 34 of support 30 and upper surface 28 of the peripherally-extending rim 22 of manhole ring 20 (e.g., even with the ground) when the cover is received in the manhole ring. The outer insulating member is also positionable between an outer surface 36 of peripherally-extending portion 32 of support 30 and an inner surface 26 of peripherally-extending rim 22 of manhole ring 20 when the cover is received in the manhole ring. As described below, the support may comprise a first material, and the outer insulating member may comprise a second material different from the first material. The outer insulating member may include a thickness of about ⅜ inch around the outer surfaces of the support.

Figure 3:
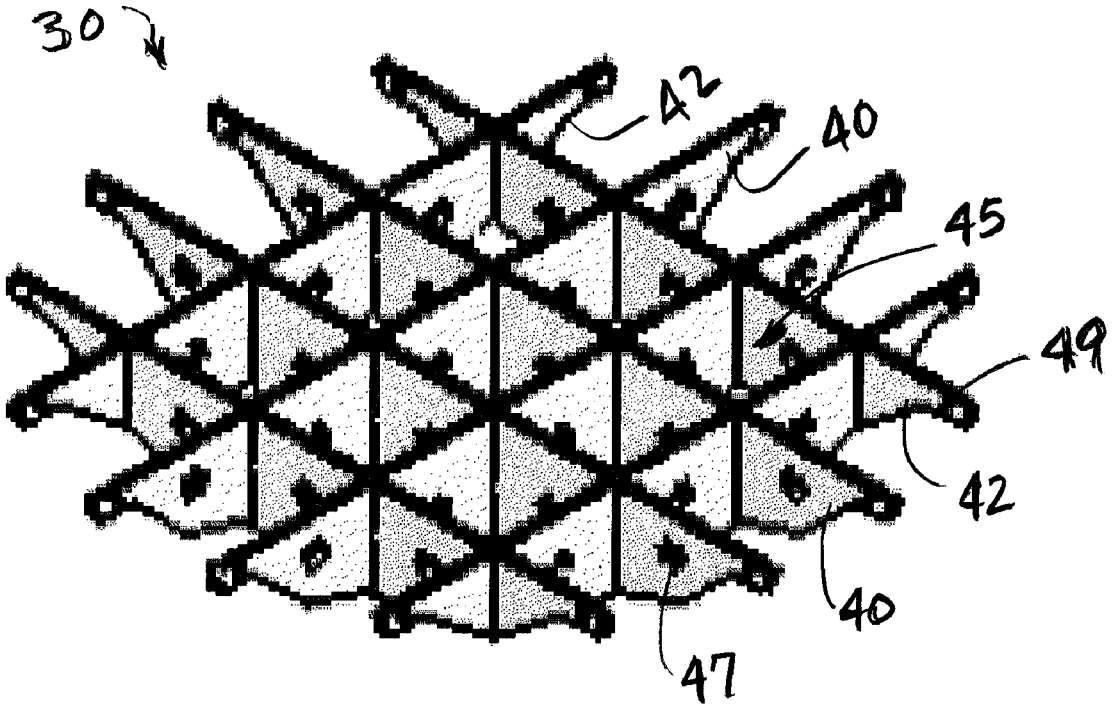
FIG. 3 is a perspective view of the support in accordance with the present invention which is disposed in the thermally and electrically insulated manhole cover of FIG. 1.
Figure 4:
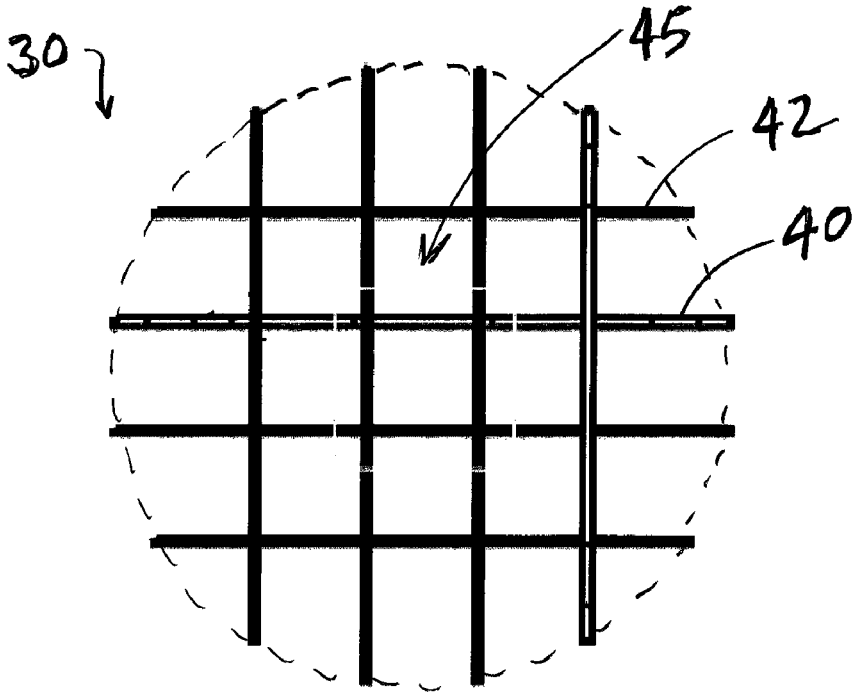
FIG. 4 is a top view of the support of FIG. 3.
Figure 5:
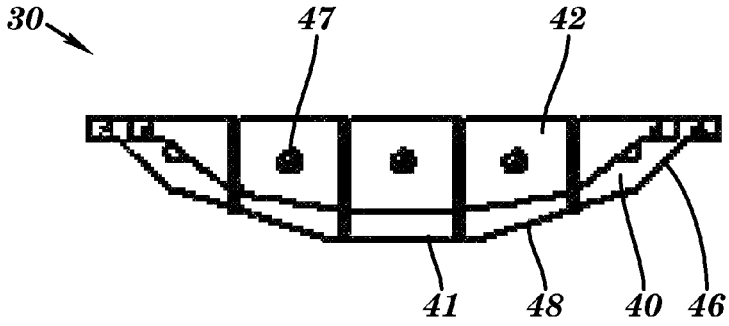
FIG. 5 is a side elevational view of the support of FIG. 3.

For example, the inner support 30, as best shown in FIGS. 3-5, may be a steel weldment formed from a plurality of spaced-apart cross-members 40 and 42 which are welded together to define a grid pattern or grate having a plurality of openings or passageways 45 between the cross-members. The cross-members may include a plurality of openings or holes 47 and 49 which are positioned and extend from one side of the cross-member to the other side. Openings 47, e.g., 1-inch diameter holes, and opening 49, e.g., ⅜-inch diameter hole, allow the outer insulating member to attach to and lock onto inner support 30

The outer cross-members 42 may be about 27 inches long and the inner cross-members 40 may be about 31 inches long. When arranged in the grid pattern, the ends of the cross-members, projections of about 1 inch long, are positioned along a circle with portions that extend over the lip (shown in dashed lines in FIG. 4) of the manhole cover. ⅜-inch thick steel may be used to form the eight intersecting cross-members and may provide a capability of supporting an 80,000 pound (lb) load applied to a 9-inch by 9-inch area in the center of the grid pattern while the perimeter, i.e., the peripherally-extending ends of the cross-members, are supported, for example by a rim of a manhole ring. In another embodiment, the inner structural member may be iron casting, e.g., formed from ductile iron ASTM A536.

Figure 6:
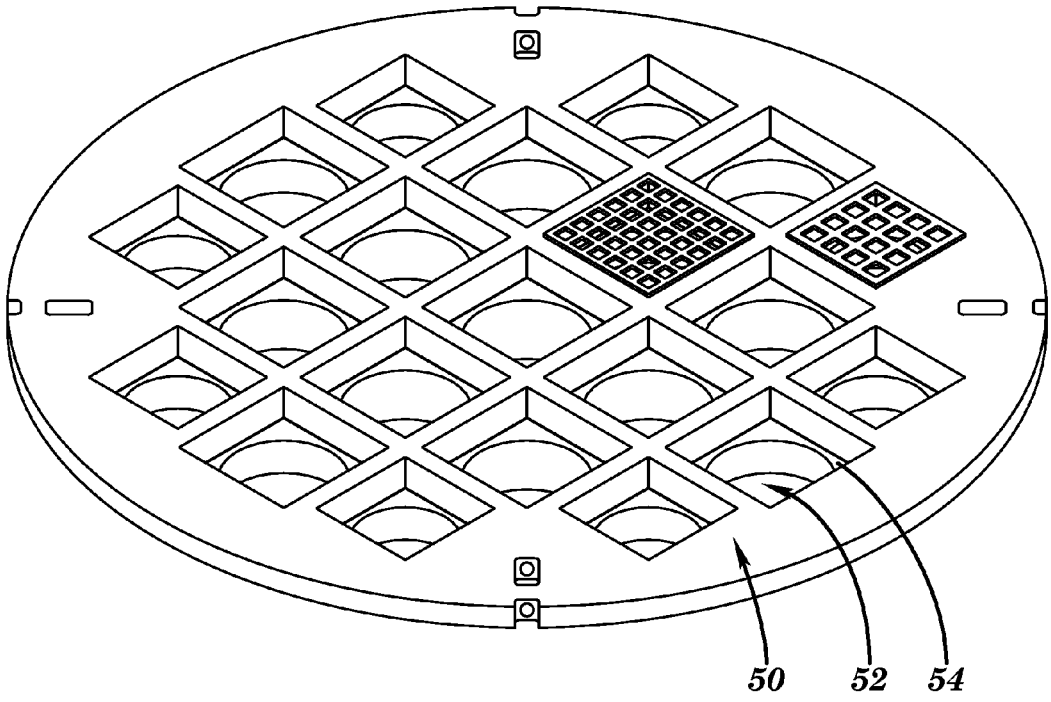
FIG. 6 is a perspective top view of the outer insulating member covering the support of the thermally and electrically insulated manhole cover of FIG. 1.
Figure 7:
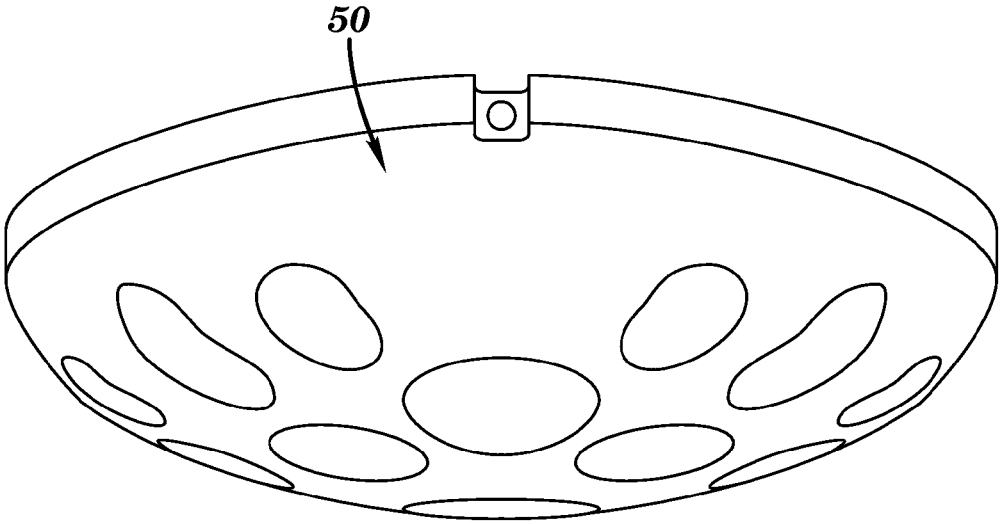
FIG. 7 is a bottom perspective view of the outer insulating member covering the support of the thermally and electrically insulated manhole cover of FIG. 1.

With reference to FIGS. 6 and 7, outer insulating member 50 may include a plurality of openings or passageways 52 which extend through the spaced-apart and intersecting cross-members 40 and 42 (FIGS. 3 and 4). As best shown in FIG. 6, the passageways 52 may include a lower circular passageway, and the upper portion may include a generally square opening. The dimensions of the square opening may be sized larger than the dimensions of the circular opening to provide a support or ledge 54 below the upper surface of the outer insulating member. The size of the square openings and the circular passageways need not all be the same size, e.g., some may be smaller and some may be larger.

The outer insulating member may be formed from a composite such as a resin or binder, reinforcement fibers, and stone aggregate. The stone aggregate may be, for example, aggregate that is use in asphalt top coats and may be about ¼-inch to about 5/16-inch in size. The resin or binder may be, for example, a vinyl ester resin, and the reinforcement fibers may be glass fibers or chopped glass fibers. It will be appreciated by those skilled in the art that other materials may be suitably employed to form the outer insulating member. The combination of the steel weldment and the aggregate may provide the cover with sufficient weight comparable to the weight of a steel or a cast iron manhole cover.

The outer insulating member may be formed around the inner support in a mold. For example, the inner structural member may be placed in a mold that has cylindrical plugs for forming the circular passageways, and square-shaped plugs releasably attachable to the top surface of the plugs for forming the recesses for the inserts. The chopped glass fibers and aggregate may be inserted into the mold and the resin may be poured or pumped into the mold to flow around the chopped glass fibers, aggregate, and the inner support. Once the resin has cured, the square-shaped plugs may be removed and the assembly of the support and cured outer insulating member may be removed from the mold.

With reference again to FIG. 5, the plurality of cross-members may comprise a plurality of vertically extending elongated ribs having peripherally-extending portions having a first height and a central portion having a second height greater than the first height. For example, with regard to cross-member 40, cross-member 40 may include a horizontally-disposed flat lower surfaces 41, and one or more angled lower surfaces 48 and 46. Cross-member 42 may be similarly configured. The outer insulating member 50 may be configured to extend from, e.g., ⅜ of an inch, and follow the contour defined by the lower surfaces of the cross-members and include a horizontally disposed lower surface (best shown in FIG. 2). It will also be appreciated that other configurations may be possible. For example, the angled lower surfaces may be curved surfaces, and the outer material may include a curved surface. Desirably, providing a horizontally extending lower surface on the outer insulating material enables the cover to sit and remain stable on the ground after the manhole cover is removed from a manhole ring. In addition, the shape of the manhole cover, and in particular, the shape of the lower surface of the outer insulating member of the manhole cover, allows a utility worker to easily apply a force at about 45-degrees to the pick holes, and remove the manhole cover from a manhole ring by rolling or sliding the lower surface on the manhole ring. The total thickness or height of the manhole cover in the center may be about 6 inches to about 7 inches.

Figure 8:
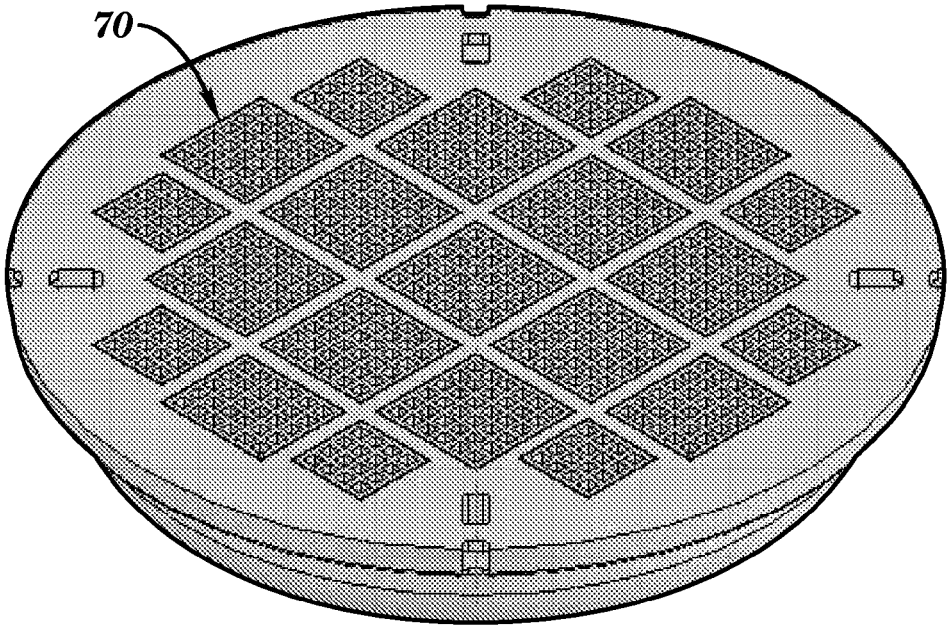
FIG. 8 is a top perspective view of the outer insulating member which covers the support, and screen inserts disposed in the outer insulating member of the thermally and electrically insulated manhole cover of FIG. 1.

With reference to FIG. 8, a plurality of inserts 70 may be placed in the square-shaped openings of the outer insulating material 50 (FIG. 6). For example, inserts 70 may include a plurality of openings 72 (FIG. 2) such as 0.5 inch by 0.5 inch openings as required by Americans with Disabilities Act, which allow pressurized air or steam in the manhole to vent out of the manhole cover. The bottom peripheral edge or vertical sides of the plurality of inserts may be bonded using a suitable adhesive to attach the inserts to the outer insulating member. The inserts may be formed from a composite material such as a polyester resin and glass fibers, or other suitable material.

In another aspect of this embodiment, the top surface of the manhole cover, e.g., the upper surface of the outer insulating member and the upper surface of the inserts may be covered or coated with a composite insulating layer 80, as shown in FIG. 2, which may include a resin or binder with glass fibers. In addition, grit or sand may be deposited or sprinkled onto the upper surface of the layer prior to the resin curing to provide a non-skid upper surface.

Figure 9:
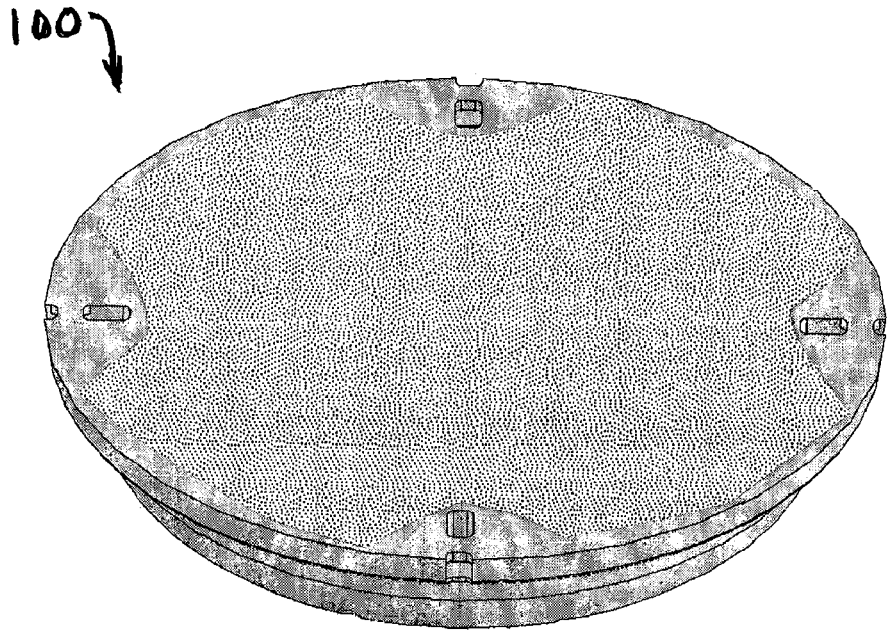
FIG. 9 is a top perspective view of an embodiment of a solid thermally and electrically insulated manhole cover in accordance with the present invention.
Figure 10:
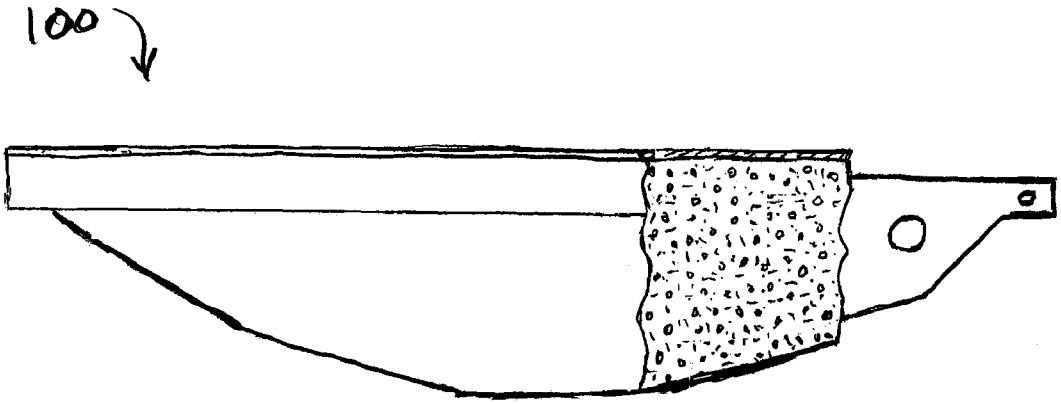
FIG. 10 is a side elevational view, partially cut away, of the solid thermally and electrically insulated manhole cover of FIG. 1 supportable in a manhole ring having a lip.

FIGS. 9 and 10 illustrate another embodiment a manhole cover 100 having a solid cover in accordance with the present invention. Manhole cover 100 is supportable on a lip of a manhole ring for covering the manhole ring. Such manhole cover 100 may be suitable used where there is no need for a venting, for example, pressurized air or steam from the manhole.

For example, manhole cover 100 maybe configured and formed essentially the same as manhole cover 10 described above, with the exception that when molding the outer insulating material, the cylindrical plugs and square shaped plugs are not employed, resulting in a solid cover which may be coated with a non-skid surface.

Figure 11:
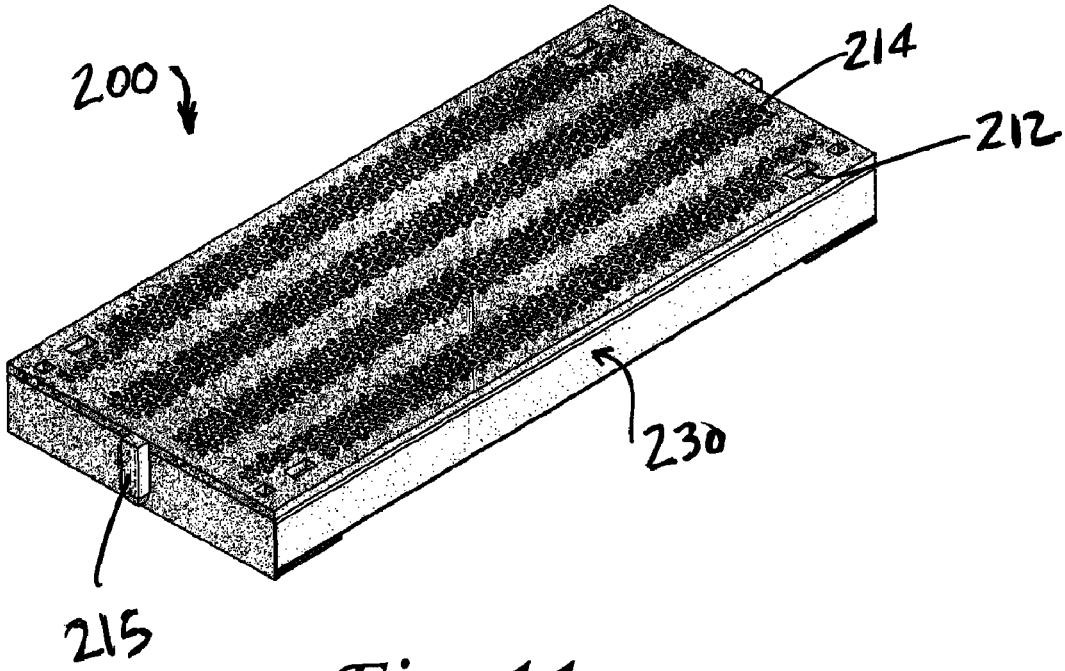
FIG. 11 is a top perspective view of another embodiment of a thermally and electrically insulated manhole cover in accordance with the present invention.
Figure 12:
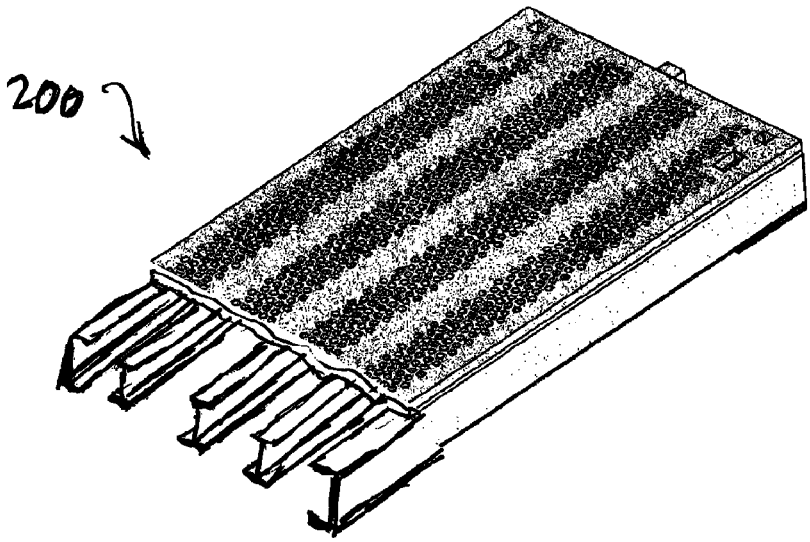
FIG. 12 is a perspective view, partially cut away, of the manhole cover of FIG. 11.

FIG. 11 is another embodiment a manhole cover 200 in accordance with the present invention. Manhole cover 200 includes a rectangular shape and a plurality of vent holes 214. Manhole cover 200 is supportable on a lip of a manhole ring for covering the manhole. In this illustrated embodiment, manhole cover 200 may include a structural member or frame 220 formed from a plurality of spaced-apart C-channels 224 and I-beams 226 as best shown in FIG. 12 and an insulating member 250 having a plurality of vents 214 disposed between the plurality of spaced-apart C-channels and I-beams. The C-channels and I-beams may be formed from steel and welded together. The insulating member may be formed from a composite including a resin or binder and glass fibers as described above. The insulating member may include a thickness of about ¾ inch.

The vents in the cover may be formed using a water jet cutter or end mill. The upper surface of the insulating material may be coated with a non-skid surface as described above. Pick holes 212 may be provided in the manhole cover for use in removing the manhole cover from the manhole ring. A plurality of keys 215 may be provided to position and maintain the cover in place wherein a plurality of covers 200 may be disposed in side-by-side relation to each other to cover the opening of manhole ring. The insulating cover may be extend across the entire upper surface of the support and be attached to the top surface thereon by binding with a suitable adhesive. The openings in the insulating member allow a release of pressure (e.g., from below ground) without dislodging. The insulating qualities of the insulating member on the top exposed surface inhibit contact with the steel portion which therefore inhibits the likelihood of burning or electrocution which may otherwise occur due to contact with such steel portion.

Figure 13:
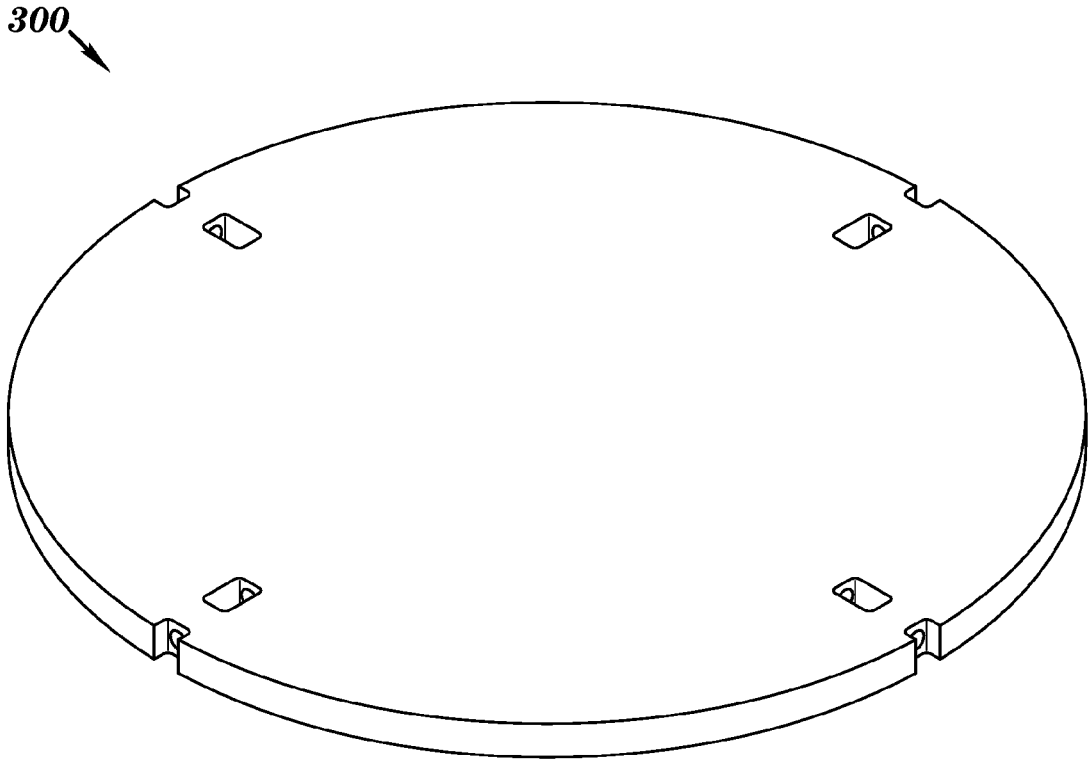
FIG. 13 is a top perspective view of another embodiment of a thermally and electrically insulated manhole cover in accordance with the present invention.
Figure 14:
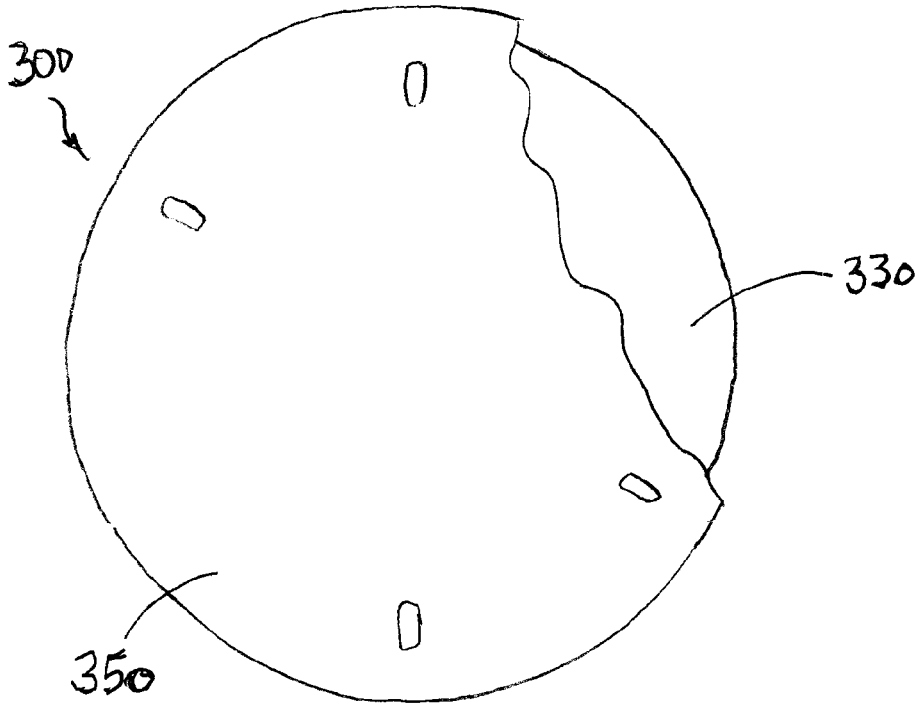
FIG. 14 is a top view, partially cut away, of the thermally and electrically insulated manhole cover of FIG. 13.
Figure 15:
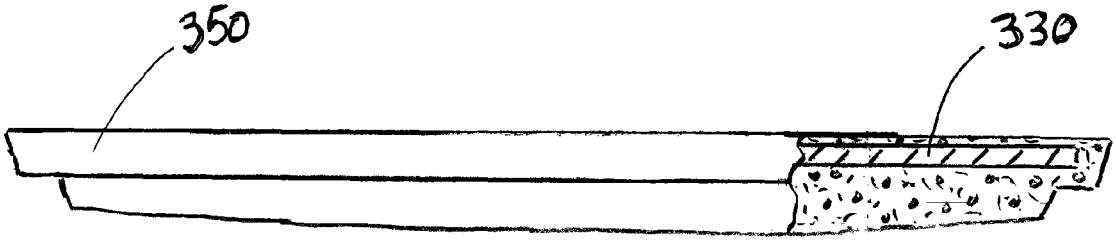
FIG. 15 is a side elevational view, partially cut away, of the thermally and electrically insulated manhole cover of FIG. 13.

FIGS. 13-15 illustrate another embodiment of a manhole cover 300 in accordance with the present invention. In this embodiment, manhole cover 300 includes a solid circular cover supportable on a lip of a manhole ring for covering the manhole. For example, manhole cover 300 may be made by encapsulating a structural steel plate or disc 330 (best shown in FIGS. 14 and 15, with a non-metallic composite 350. The non-metallic composite 350 maybe suitably molded around structural steel plate 330. The steel plate may be cast iron, ASTM 536, or structural steel, with a thickness of about 0.75 inch and the non-metallic composite may be formed from a composite including a resin or binder and glass fibers as described above. The upper surface of the insulating material may be coated with a non-skid surface as also described above. The plate may be strategically sized and located so as to minimize the temperature rise of the cover, prevent the exposed surface from becoming electrified, and at the same time provide the cover the same strength and weight of traditional cast iron manhole covers. For example, the plate may be located in such composite material such that it extends horizontally from one side of a manhole support structure or rim to another, thereby providing structural support inhibiting the manhole cover from extending vertically, or falling, through a hole in a manhole ring. Further, the plate is located vertically within in the composite material such that it is not exposed on an upper or lower horizontal surface thereof.

Also, the plate is located within the composite such that its outer peripheral edges are not exposed to the surrounding ambient environment.

In the various embodiments, the structural member or support and the outer insulating member together provide sufficient weight to inhibit the likelihood of theft and movement of the cover by flooding or other such events. The outer insulating member inhibits the likelihood of electrocution or burning which might occur by direct contact of an individual with a steel manhole cover in the event of such a manhole cover being exposed to hot gas or electric current. The inner support (e.g., steel or iron) may reduce the likelihood of a catastrophic failure of the cover even under extreme and prolonged high temperature conditions, such as may occur with an underground fire or steam leak.

It will be appreciated that the insulating member may comprise polyester or epoxy resins as matrix, glass fibers as reinforcement, however other suitable resins and fibers may be employed such as aramid, carbon, or boron fibers. In further embodiments, the inner structural member or support may have any suitable configuration, and be integral with the outer insulating member of the cover.

The present invention may overcome the various problems associated with metal covers and non-metal covers. For example, metal covers typically have two problems as they relate to pedestrian traffic. First, because the covers may be exposed to steam or other heat sources from below, the surface temperature of the cover can rise to a sufficiently high temperature to cause burns. Second, the covers may become electrified by an undetected electrical fault below the street exposing animals and humans to electrocution. The present invention provides covers having suitable insulating properties reducing the likelihood of risks of burning and electrocution associated with conventional metal manhole covers.

With regard to low-density, non-metallic cover, these covers tend to float out of position during a flooding event, leaving a potentially dangerous uncovered hole. The cover could also be dislodged by a relatively modest pressure rise below ground, caused, for instance, by a steam leak. Second, vandalism and theft are invited by the relative ease of moving a cover that is less than fifth the weight of the traditional cast iron cover. Even with special locking mechanisms proposed by some manufacturers of nonmetallic covers, such locking mechanisms require special unlocking tools. The locking mechanisms also inevitably fail from the effects of water, salt, sand, steam, extremes of temperature and intermittent load. Thirdly, composites become severely weakened at high temperatures that may be caused by a steam leak or underground fire. The present invention provides covers having suitable weight and overcomes the problem of light weight covers fabricated from non-metallic materials.

Although the invention has been particularly shown and described with reference to certain preferred embodiments, it will be readily appreciated by those of ordinary skill in the art that various changes and modifications may be made therein, without departing from the spirit and scope of the invention.

The invention claimed is:

1. A manhole cover for use in covering a manhole ring having a rim and a lip, said manhole cover comprising:

a support having an upper surface, said support comprising a plurality of passageways therethrough;

an outer thermally and electrically insulating member disposed over the entire upper surface of said support and between said passageways of said support, said support comprising a first material, and said outer insulating member comprising a second material different from said first material;

wherein a peripherally-extending portion of said support is positionable over the lip of the manhole ring and spaced adjacent to an inner surface of the rim of the manhole ring, and said outer insulating member is positionable between said upper surface of said support and the upper surface of the rim of the manhole ring when the manhole cover is received in the manhole ring; and wherein said outer insulating member is operable to provide said manhole cover with a reduced likelihood of thermal and electrical burns and electrocution upon contact compared to contact with a conventional metal manhole cover.

2. The manhole cover of claim 1 wherein said peripherally-extending portion of said support is spaced-apart from the inner surface of the rim of the manhole ring.

3. The manhole cover of claim 2 wherein said outer insulating member is disposed between the peripherally-extending portion of said support and an inner surface of said ring.

4. The manhole cover of claim 3 wherein said support comprises a plurality of spaced-apart cross-members defining a grate defining said plurality of passageways through said support, and wherein the ends of some of said plurality of spaced-apart cross-members define said peripherally-extending portion of said support comprising a plurality of spaced-apart peripherally-extending portions positionable over the lip of the manhole ring.

5. The manhole cover of claim 4 wherein some of said plurality of cross-members comprises a plurality of vertically extending elongated ribs having peripherally-extending portions having a first height and a central portion having a second height greater than the first height.

6. The manhole cover of claim 4 wherein said cross-members comprises a plurality of openings through some of said cross-members for locking said outer insulating member to said support.

7. The manhole cover of claim 4 wherein said outer insulating member comprises a composite of resin and stone aggregate.

8. The manhole cover of claim 4 wherein said outer insulating member comprises a composite of resin, reinforcement fibers, and stone aggregate.

9. The manhole cover of claim 4 wherein said support comprises metal.

10. The manhole cover of claim 4 wherein said support comprises metal, and said outer insulating member comprises a composite of resin, reinforcement fibers, and stone aggregate.

11. The manhole cover of claim 4 wherein said outer insulating member is disposed below said support and positionable between a lower surface of said peripherally-extending portion of said support and an upper surface of the lip of the manhole ring.

12. The manhole cover of claim 4 wherein said outer insulating member generally encases the entire outer surfaces of said cross-members.

13. The manhole cover of claim 4 wherein said outer insulating member defines a solid manhole cover.

14. The manhole cover of claim 4 wherein said outer insulating member defines a plurality of passageways aligned with at least some of said plurality of passageways extending through said support.

15. The manhole cover of claim 14 further comprising a plurality of screen inserts disposed in said plurality of passageways of said outer insulating member.

16. The manhole cover of claim 1 wherein:

said support comprises a plurality of spaced-apart cross-members defining a grate having a plurality of passageways through said support, and the ends of some of said plurality of spaced-apart cross-members define said peripherally-extending portion of said support comprising a plurality of spaced-apart peripherally-extending portions positionable over the lip of the manhole ring;

some of said plurality of cross-members comprising a plurality of vertically extending elongated ribs having peripherally-extending portions having a first height and a central portion having a second height greater than the first height;

said support comprising metal;

said outer insulating member encases the entire outer surfaces of said cross-members; and said outer insulating member comprising a composite of resin, reinforcement fibers, and stone aggregate.

17. The manhole cover of claim 16 wherein said plurality of spaced-apart cross-members comprising a plurality of openings through some of said plurality of spaced-apart cross-members for locking said outer insulating member to said support.

18. The manhole cover of claim 17 wherein said outer insulating member defines a solid manhole cover.

19. The manhole cover of claim 17 wherein said outer insulating member defines a plurality of passageways aligned with at least some of said plurality of passageways extending through said support.

20. The manhole cover of claim 18 further comprising a plurality of screen inserts disposed across said plurality of passageways of said outer insulating member.

21. The manhole cover of claim 1 wherein said outer insulating member comprises a composite of resin and stone aggregate.

22. The manhole cover of claim 1 wherein said support comprises metal.

23. The manhole cover of claim 1 wherein said support comprises metal, and said outer insulating member comprises a composite of resin, reinforcement fibers, and stone aggregate.

24. The manhole cover of claim 1 wherein said support comprises metal, and said outer insulating member comprises a composite of resin and reinforcement fibers.

25. The manhole cover of claim 1 wherein said outer insulating member encases said support.

26. The manhole cover of claim 25 wherein said support comprises metal, and said outer insulating member comprises a composite of resin and reinforcement fibers.

27. The manhole cover of claim 1 wherein said outer insulating member defines a solid manhole cover.

28. The manhole cover of claim 1 wherein said support outer insulating member comprises a plurality of passageways extending through said passageways of said support.

29. The manhole cover of claim 28 further comprising a plurality of screen inserts disposed in said plurality of passageways of said outer insulating member.

30. The manhole cover of claim 1 wherein said peripherally-extending portion of said support comprises a plurality of spaced-apart peripherally-extending passageways defining a plurality of spaced-apart peripherally-extending portions positionable over the lip of the manhole ring.

31. The manhole cover of claim 1 wherein said outer insulating member comprises a lower surfaced having a central flat horizontally-extending surface, and at least one of angled and curved lower side surfaces.

32. A combination manhole ring and manhole cover, said combination comprising:

a manhole ring having an opening; and a manhole cover of claim 1 disposed in said opening.

33. A combination manhole ring and manhole cover, said combination comprising:

a manhole ring having an opening; and a manhole cover of claim 4 disposed in said opening.

34. A combination manhole ring and manhole cover, said combination comprising:

a manhole ring having an opening; and a manhole cover of claim 16 disposed in said opening.

35. A combination manhole ring and manhole cover, said combination comprising:

a manhole ring having an opening; and a manhole cover of claim 23 disposed in said opening.

36. A combination manhole ring and manhole cover, said combination comprising:

a manhole ring having an opening; and a manhole cover of claim 24 disposed in said opening.

37. A combination manhole ring and manhole cover, said combination comprising:

a manhole ring comprising a rim and a lip; and a manhole cover disposed in said manhole ring, said manhole cover comprising:

a support having an upper surface;

an outer thermally and electrically insulating member disposed over the entire upper surface of said support, said support comprising a first material, and said outer insulating member comprising a second material different from said first material;

wherein a peripherally-extending portion of said support is positionable over said lip of said manhole ring and spaced adjacent to an inner surface of said rim of said manhole ring, and said outer insulating member is positionable between said upper surface of said support and the upper surface of said rim of said manhole ring when the manhole cover is received in the manhole ring;

wherein said outer insulating member comprises a composite of resin and stone aggregate; and wherein said outer insulating member is operable to provide said manhole cover with a reduced likelihood of thermal and electrical burns and electrocution upon contact compared to contact with a conventional metal manhole cover.

38. A method for forming a manhole cover for use in covering a manhole ring having a rim and a lip, the method comprising:

providing a support having an upper surface and a peripherally-extending portion, the support comprising a plurality of passageways therethrough;

providing an outer thermally and electrically insulating member disposed over the entire upper surface of the support and between the passageways of the support, the support comprising a first material, and the outer insulating member comprising a second material different from the first material;

wherein the peripherally-extending portion of the support is positionable over the lip of the manhole ring and spaced adjacent to an inner surface of the rim of the manhole ring, and the outer insulating member is positionable between the upper surface of the support and the upper surface of the rim of the manhole ring when the manhole cover is received in the manhole ring; and wherein the outer insulating member is operable to provide the manhole cover with a reduced likelihood of thermal and electrical burns and electrocution upon contact compared to contact with a conventional metal manhole cover.

39. The method of claim 38 wherein the providing the support comprises providing a plurality of spaced-apart cross-members defining a grate defining the plurality of passageways through the support, and ends of some of the plurality of spaced-apart cross-members define the peripherally-extending portion of the support comprising a plurality of spaced-apart peripherally-extending portions positionable over the lip of the manhole ring.

40. The method of claim 38 wherein the providing the outer insulating member comprises molding a composite of resin, fiber reinforcement, and stone aggregate.

41. The method of claim 39 wherein the providing the outer insulating member comprises molding the outer insulating member in a plurality of openings extending through some of the cross-members for locking the outer insulating member to the support.

42. The method of claim 40 wherein the providing the outer insulating member comprises molding a plurality of passageways extending through the support.

43. The method of claim 42 further comprising providing a plurality of screen inserts having a plurality of openings disposed in the plurality of passageways of the outer insulating member.

44. The method of claim 38 wherein the providing the support comprises providing a metal support, and the providing the outer insulating member comprises providing a composite of resin, reinforcement fibers, and stone aggregate, and further comprising encasing the entire outer surface of the support with the composite.

45. A manhole cover for use in covering a manhole ring having a rim and a lip, said manhole cover comprising:

a support having an upper surface, said support comprising a plurality of passageways therethrough, and said support comprising a plurality of spaced-apart cross-members defining a grate defining said plurality of passageways;

an outer thermally and electrically insulating member disposed over the entire upper surface of said support and between said passageways of said support, said support comprising a first material, and said outer insulating member comprising a second material different from said first material;

wherein a peripherally-extending portion of said support is positionable over the lip of the manhole ring and spaced adjacent to an inner surface of the rim of the manhole ring, and said outer insulating member is positionable between said upper surface of said support and the upper surface of the rim of the manhole ring when the manhole cover is received in the manhole ring; and wherein said outer insulating member is operable to provide said manhole cover with a reduced likelihood of thermal and electrical burns and electrocution upon contact compared to contact with a conventional metal manhole cover.

46. The manhole cover of claim 45 wherein some of said plurality of cross-members comprises a plurality of vertically extending elongated ribs having peripherally-extending portions having a first height and a central portion having a second height greater than the first height.

47. The manhole cover of claim 45 wherein said outer insulating member generally encases the entire outer surfaces of said cross-members.

48. The manhole cover of claim 45 wherein said plurality of spaced-apart cross-members comprises a plurality of openings through some of said plurality of spaced-apart cross-members for locking said outer insulating member to said support.

49. The manhole cover of claim 45 wherein said outer insulating member defines a plurality of passageways aligned with at least some of said plurality of passageways extending through said support.

50. The manhole cover of claim 49 further comprising a plurality of screen inserts disposed in said plurality of passageways of said outer insulating member.

51. The manhole cover of claim 45 wherein some of said plurality of cross-members comprises a plurality of vertically extending elongated ribs having peripherally-extending portions having a first height and a central portion having a second height greater than the first height, said support comprises metal, said outer insulating member comprises a composite of resin, and at least one of reinforcement fibers and stone aggregate.

52. The manhole cover of claim 51 wherein said outer insulating member encases the entire outer surfaces of said cross-members.

53. The manhole cover of claim 51 wherein said plurality of spaced-apart cross-members comprises a plurality of openings through some of said plurality of spaced-apart cross-members for locking said outer insulating member to said support.

54. The manhole cover of claim 51 wherein said outer insulating member defines a plurality of passageways aligned with at least some of said plurality of passageways extending through said support.

55. The manhole cover of claim 54 further comprising a plurality of screen inserts disposed in said plurality of passageways of said outer insulating member.

56. A manhole cover for use in covering a manhole ring having a rim and a lip, said manhole cover comprising:

a support having an upper surface;

an outer thermally and electrically insulating member disposed over the entire upper surface of said support, said support comprising a first material, and said outer insulating member comprising a second material different from said first material;

wherein a peripherally-extending portion of said support is positionable over the lip of the manhole ring and spaced adjacent to an inner surface of the rim of the manhole ring, and said outer insulating member is positionable between said upper surface of said support and the upper surface of the rim of the manhole ring when the manhole cover is received in the manhole ring;

said support comprising a plurality of spaced-apart cross-members defining a grate having a plurality of passageways through said support, and wherein the ends of some of said plurality of spaced-apart cross-members define said peripherally-extending portion of said support comprising a plurality of spaced-apart peripherally-extending portions positionable over the lip of the manhole ring;

said cross-members comprising a plurality of openings through some of said cross-members for locking said outer insulating member to said support; and wherein said outer insulating member is operable to provide said manhole cover with a reduced likelihood of thermal and electrical burns and electrocution upon contact compared to contact with a conventional metal manhole cover.

57. The manhole cover of claim 56 wherein said outer insulating member comprises a composite of resin and stone aggregate.

58. The manhole cover of claim 56 wherein said outer insulating member comprises a composite of resin, reinforcement fibers, and stone aggregate.

59. A manhole cover for use in covering a manhole ring having a rim and a lip, said manhole cover comprising:

a support having an upper surface;

an outer thermally and electrically insulating member disposed over the entire upper surface of said support, said support comprising a first material, and said outer insulating member comprising a second material different from said first material;

wherein a peripherally-extending portion of said support is positionable over the lip of the manhole ring and spaced adjacent to an inner surface of the rim of the manhole ring, and said outer insulating member is positionable between said upper surface of said support and the upper surface of the rim of the manhole ring when the manhole cover is received in the manhole ring;

said outer insulating member comprises a composite of resin and stone aggregate; and wherein said outer insulating member is operable to provide said manhole cover with a reduced likelihood of thermal and electrical burns and electrocution upon contact compared to contact with a conventional metal manhole cover.

60. The manhole cover of claim 59 wherein said outer insulating member defines a solid manhole cover.

61. The manhole cover of claim 59 wherein said outer insulating member comprises a plurality of passageways extending through said passageways of said support.

62. The manhole cover of claim 61 further comprising a plurality of screen inserts disposed in said plurality of passageways of said outer insulating member.

63. The manhole cover of claim 59 wherein said support comprises a plurality of spaced-apart cross-members defining a grate defining a plurality of passageways therethrough.

64. The manhole cover of claim 59 wherein said support comprises a plurality of spaced-apart I-beam members and C-channels.

65. The manhole cover of claim 64 wherein said outer insulating member comprises a plurality of passageways therethrough generally aligned with said openings disposed between said plurality of spaced-apart I-beam members and C-channels.

66. A method for forming a manhole cover for use in covering a manhole ring having a rim and a lip, the method comprising:

providing a support having an upper surface and a peripherally-extending portion;

providing an outer thermally and electrically insulating member comprising a composite of resin and stone aggregate disposed over the entire upper surface of the support, the support comprising a first material, and the outer insulating member comprising a second material different from the first material;

wherein the peripherally-extending portion of the support is positionable over the lip of the manhole ring and spaced adjacent to an inner surface of the rim of the manhole ring, and the outer insulating member is positionable between the upper surface of the support and the upper surface of the rim of the manhole ring when the manhole cover is received in the manhole ring; and wherein the outer insulating member is operable to provide the manhole cover with a reduced likelihood of thermal and electrical burns and electrocution upon contact compared to contact with a conventional metal manhole cover.

67. The method of claim 66 wherein the outer insulating member defines a solid manhole cover.

68. The method of claim 66 wherein the support comprises a plurality of passageways therethrough, and the outer insulating member comprises a plurality of passageways extending through the passageways of the support.

69. The method of claim 68 further comprising a plurality of screen inserts disposed in the plurality of passageways of the outer insulating member.

70. The method of claim 66 wherein the providing the support comprises providing a plurality of spaced-apart I-beam members and C-channels.

71. The method of claim 66 wherein the providing the support comprises providing a metal support, and the providing the outer insulating member comprises providing composite comprising a composite of resin, reinforcement fibers, and stone aggregate, and further comprising encasing the entire outer surface of the support with the composite.

72. A manhole cover for use in covering a manhole ring having a rim and a lip, said manhole cover comprising:

a support comprising a solid plate and having an upper surface;

an outer thermally and electrically insulating member disposed over the entire upper surface of said support and encasing said support, said support comprising a first material, and said outer insulating member comprising a second material different from said first material;

wherein a peripherally-extending portion of said support is positionable over the lip of the manhole ring and spaced adjacent to an inner surface of the rim of the manhole ring, and said outer insulating member is positionable between said upper surface of said support and the upper surface of the rim of the manhole ring when the manhole cover is received in the manhole ring;

wherein said support comprises metal, and said outer insulating member comprises a composite of resin and reinforcement fibers; and wherein said outer insulating member is operable to provide said manhole cover with a reduced likelihood of thermal and electrical burns and electrocution upon contact compared to contact with a conventional metal manhole cover.

73. The manhole cover of claim 72 wherein said peripherally-extending portion of said support is spaced-apart from the inner surface of the rim of the manhole ring.

74. The manhole cover of claim 72 wherein said outer insulating member is disposed between the peripherally-extending portion of said support and an inner surface of said ring.

75. The manhole cover of claim 72 further comprising a manhole ring having an opening.

* * * * *

UNITED STATES PATENT AND TRADEMARK OFFICE

CERTIFICATE OF CORRECTION

PATENT NO. : 7,914,227 B2
APPLICATION NO. : 12/466201
DATED : March 29, 2011
INVENTOR(S) : Jordan et al.

It is certified that error appears in the above-identified patent and that said Letters Patent is hereby corrected as shown below:

Column 9
Line 49
Delete "support"

Signed and Sealed this
Twelfth Day of July, 2011

David J. Kappos

David J. Kappos
*Director of the United States Patent and Trademark Office*